US007375643B2

(12) United States Patent
McAward

(10) Patent No.: US 7,375,643 B2
(45) Date of Patent: May 20, 2008

(54) THROUGH A WALL COMBUSTION DETECTOR

(75) Inventor: James G. McAward, Blue Point, NY (US)

(73) Assignee: Honeywell International, Inc., Morristown, NJ (US)

( * ) Notice: Subject to any disclaimer, the term of this patent is extended or adjusted under 35 U.S.C. 154(b) by 373 days.

(21) Appl. No.: 10/989,160

(22) Filed: Nov. 15, 2004

(65) Prior Publication Data

US 2006/0105280 A1 May 18, 2006

(51) Int. Cl.
*G08B 12/10* (2006.01)

(52) U.S. Cl. ..... 340/628; 340/603; 340/540; 110/184; 110/193; 126/500

(58) Field of Classification Search ..... 340/603, 340/540; 110/184, 193; 126/500
See application file for complete search history.

(56) References Cited

U.S. PATENT DOCUMENTS 4,560,873 A * 12/1985 McGowan et al. .... 250/339.09
4,833,458 A * 5/1989 Bowman ..... 340/628
4,968,975 A * 11/1990 Fritz ..... 340/628
4,987,958 A * 1/1991 Fierbaugh ..... 169/57
5,594,422 A * 1/1997 Huey et al. ..... 340/628
5,633,628 A * 5/1997 Denny et al. ..... 340/584
6,121,885 A * 9/2000 Masone et al. ..... 340/628
6,624,750 B1 * 9/2003 Marman et al. ..... 340/506
6,983,666 B2 * 1/2006 Merz et al. ..... 73/866.5
7,021,165 B2 * 4/2006 Brunck et al. ..... 73/866.5
2003/0189966 A1 * 10/2003 McCarren ..... 374/11

* cited by examiner

*Primary Examiner*—Benjamin C. Lee
*Assistant Examiner*—Samuel J. Walk
(74) *Attorney, Agent, or Firm*—Welsh & Katz, Ltd.

(57) ABSTRACT

A detector of combustion products in air gaps adjacent to chimneys or flues has an air gap detection unit coupled to a displaced control unit. The control unit can be located adjacent to a proximal, exposed, surface of a wall. When so installed, the detection unit is located in an air space adjacent to the chimney or flue. The assembly can be removed for cleaning or maintenance.

8 Claims, 3 Drawing Sheets

Fig. 6
Fig. 3
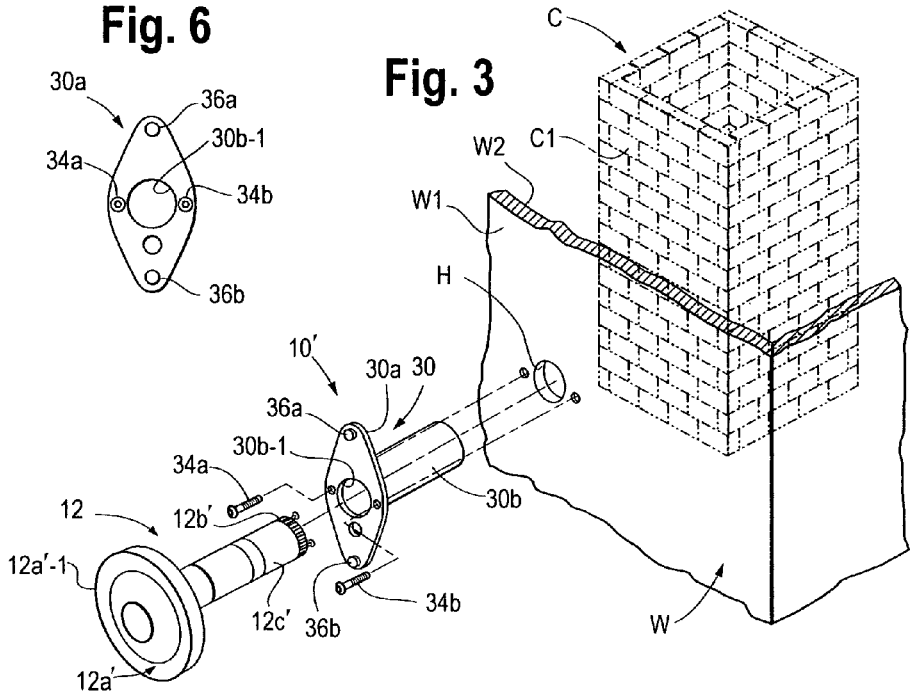
Fig. 4A
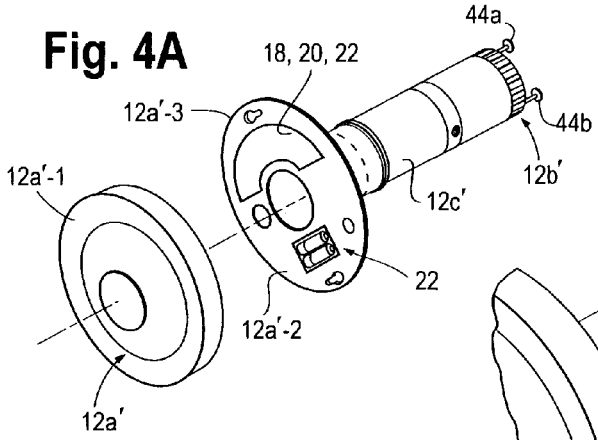
Fig. 4B
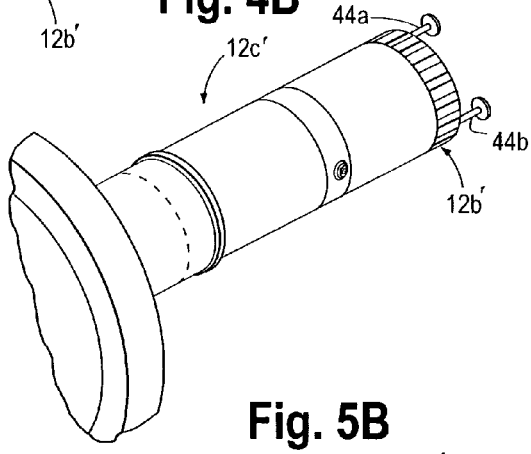
Fig. 5A
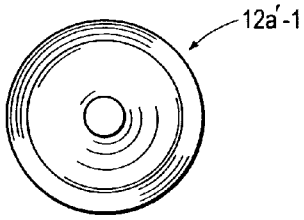
Fig. 5B
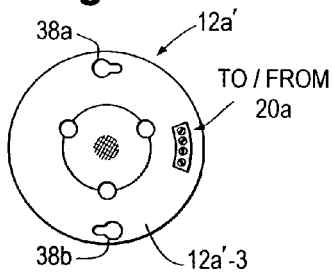

THROUGH A WALL COMBUSTION DETECTOR

FIELD OF THE INVENTION

The invention pertains to detectors of products of combustion. More particularly, the invention pertains to such detectors which sense products of combustion behind walls and adjacent to chimneys or flues.

BACKGROUND OF THE INVENTION

It has been recognized that chimney fires are one of the leading causes of fires in buildings with frame construction. A chimney fire may smoulder for an extended period of time. It may only be detected after it has involved other parts of the structure or the building.

Known buildings with frame construction which incorporate chimneys or flues usually provide an air space between the sides of the chimney or flue in the adjacent walls. The air space or gap provides a form of insulation and separates the wall from the side of the chimney or flue.

Because the interior walls usually surround those portions of the chimney or flue which are within the building, the air space or gap between the adjacent walls and the surfaces of the chimney or flue is usually not accessible for monitoring purposes. It would be desirable to be able to monitor ambient conditions in the air space. Potential monitorable conditions include the presence of smoke, gas and temperature in the air and the gap.

There is thus a need for a detector structure which is suitable for monitoring ambient conditions in the gap or space between respective wall(s) and adjacent surfaces of a chimney or flue. Preferably, such devices could be installed in new construction as well as in existing buildings. It would be preferable also if such detectors had an esthetically acceptable appearance once installed. Further, it would be desirable to be able to readily conduct maintenance and check operational conditions of the respective detector after installation.

It would also be desirable if the design of such detector overcame problems associated with use of current smoke or fire detectors which are not suitable for monitoring the gap or space between the wall of the flue since they must be installed entirely within the protected area. Since they must be regularly maintained to provide ongoing proper operation such installations are not feasible.

BRIEF DESCRIPTION OF THE DRAWINGS

FIG. 3 is an exploded view of a fire detector as in FIG. 1;

FIG. 4A is an enlarged exploded view of a portion of the detector of FIG. 3;

FIG. 4B is an enlarged fragmentary view of a portion of the detector of FIG. 4A;

FIG. 5A is a front elevational view of the detector of FIG. 3;

FIG. 5B is a rear elevational view of the detector of FIG. 3; and

FIG. 6 is a front elevational view of a mounting flange of the detector of FIG. 3.

DETAILED DESCRIPTION OF THE EMBODIMENTS

Figure 1:
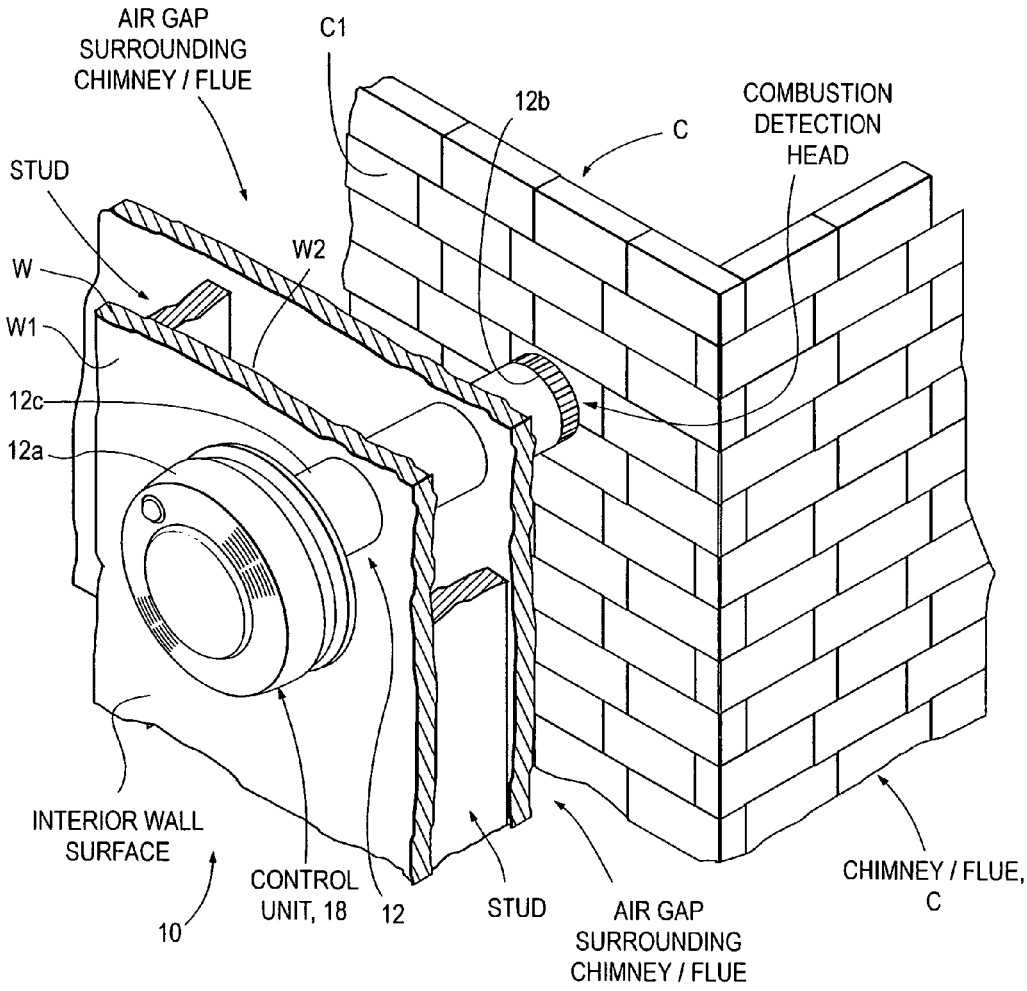
FIG. 1 is a partial isometric view of a wall adjacent to a chimney with a detector in accordance with the invention installed therein.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

In accordance with the invention, early detection of chimney fires can be achieved by detecting combustion products such as smoke, gas or conditions such as temperature in the air gap or space between chimney or flue and the adjacent wall or walls. In a disclosed embodiment, an elongated detector can be mounted on an interior wall which is adjacent to but spaced from a chimney or flue by an air gap. The detector extends through an opening in the interior wall and into the air gap surrounding the chimney or flue.

The disclosed detector has several advantages. It can be readily installed and appear esthetically acceptable on an interior surface of a wall. It can also be removed for maintenance and service, as needed and readily replaced.

A disclosed embodiment includes one or more ambient condition sensors which respond to smoke, gas or thermal energy. The sensor is coupled to a displaced control unit which can be in either wired or wireless communication with a displaced alarm system. In a wired configuration, electrical energy can be provided by the wiring to power the detector. Alternately, or as backup, batteries can be provided.

In accordance with the invention, control electronics and associated interface circuitry can be mounted on an interior wall of the respective structure. This provides easy access not only for making connections but for purposes of testing the detector.

The detector incorporates an elongated housing which extends through an opening in the respective wall. A distal end of the housing carries one or more sensors. When installed, the distal end of the housing positions the one or more sensors in the air gap thereby providing for monitoring of same.

The housing can be adjustable in length so as to be usable with different wall thicknesses and different air gap depths. For example, without limitation, the housing can be slotted to provide for axial movement of one part of the housing relative to another so as to change its length. In yet another embodiment, two portions of the housing can be rotatable relative to one another to provide a length adjustment.

When installed, the detector can continuously monitor the air space or gap, and can detect the presence of by-products of combustion such as smoke, gas or thermal energy in the air gap around the chimney before the fire involves other building structures. Such monitoring can be expected to provide additional time to evacuate the building as well as extinguish the fire and possibly minimize damage to the structure.

The detector can also be used to monitor any interior "dead air" space in a structure where there may be limited access. Applications could include monitoring attic spaces, elevator shafts or ductwork.

The detector can be removed from the wall to carry out any required maintenance. Subsequently, the detector can be reinstalled to continue monitoring the gap. Removal and reinstallation can be facilitated, in a disclosed embodiment, by providing a mounting flange attached to an interior surface of the wall. The mounting flange could also incorporate a receiving tube for the housing of the detector.

The sensor or sensors can be implemented, without limitation, as photoelectric smoke sensors, ionization-type smoke sensors, thermal sensors as well as gas sensors which use a variety of technologies. All such variations and sensor combinations come within the spirit and scope of the invention.

FIG. 1 illustrates a detector 10 which embodies the invention. The detector can include an elongated housing 12 with a proximal end housing section 12*a* and a distal end sensor carrying section 12*b* joined by a, preferably, variable length section 12*c*.

The proximal end portion of the housing 12*a* includes local control electronics, discussed in more detail subsequently. The distal end detection head portion 12*b* carries one or more ambient condition sensors which monitor conditions within an air gap which surrounds a chimney or flue generally indicated generally at C. The air gap is bounded on one side by a surface C1 of the chimney or flue and on the other side by a wall W which has an interior surface W1 and air gap side surface W2. As discussed subsequently, the wall W has an opening or hole generally indicated at H (best seen in FIG. 3) through which the elongated portion 12*c* can extend to locate the sensing head portion 12*b* in the air gap.

Those of skill will understand that the detector 10 can be removed from the wall W for maintenance purposes and readily be replaced. When replaced, the detection head portion 12*b* is again located in the air gap to monitor conditions therein.

Figure 2:
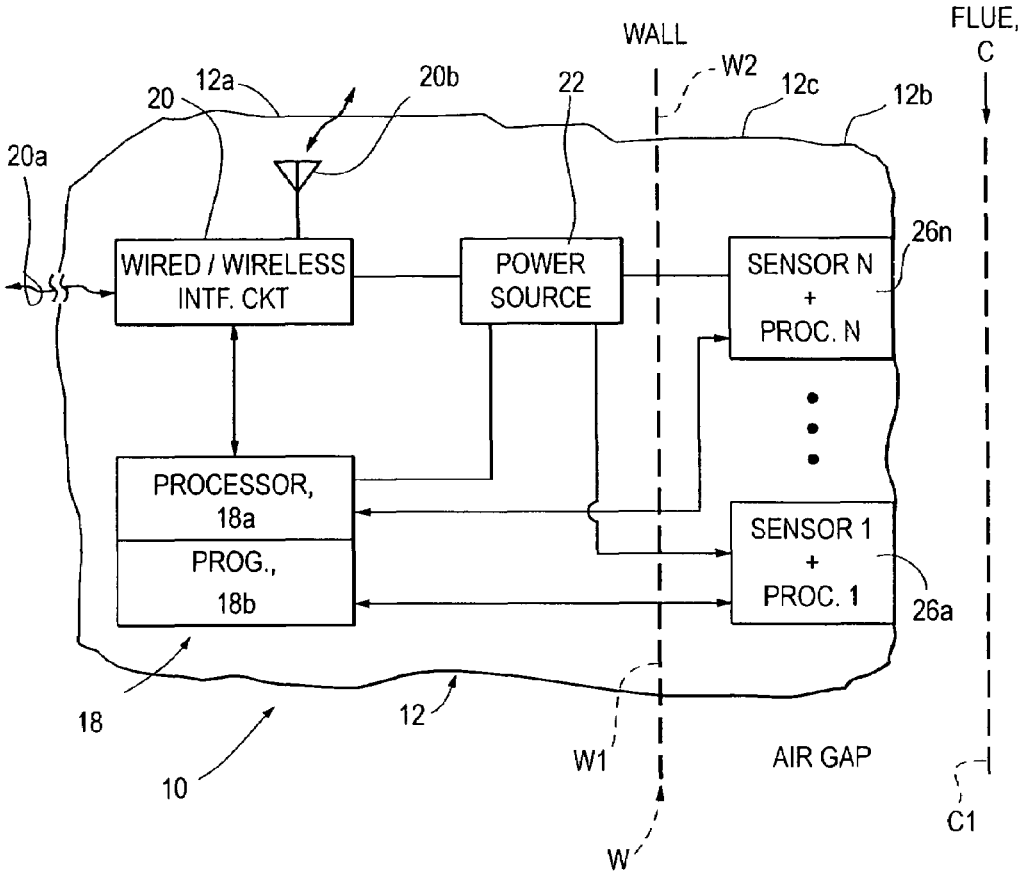
FIG. 2 is a block diagram of a detector as in FIG. 1.

FIG. 2 illustrates the various electronic aspects of the exemplary detector 10. The detector 10 includes control circuitry 18 which could be implemented, at least in part, with a programmable processor 18*a* and control program 18*b*. The control circuitry 18 is located on the interior surface W1 of the wall W for easy access and maintenance.

Circuitry 18 is coupled to wired or wireless interface circuitry 20. In one embodiment, the interface circuitry 20 can be coupled to a local alarm system via cables or wiring 20*a*. Alternately, circuitry 20 can communicate wirelessly via antenna 20*b* with an adjacent alarm system.

The detector 10 can incorporate a power source 22 which might receive electrical energy from the cables or wire 20*a*. Alternately, the source 22 could incorporate one or more batteries which might be rechargeable.

The control circuitry 18 is coupled to one or more ambient condition sensors such as Sensor 1, Sensor 2 . . . Sensor N. The sensors are carried by housing 12 at distal end 12*b* and located in the air gap which is to be monitored. It will be understood that the sensors could be implemented with a variety of sensing technologies for a variety of ambient conditions. All such variations come within the spirit and scope of the present invention.

For example, Sensor i could correspond to a photoelectric or ionization type smoke sensor. Alternately, it could correspond to a gas sensor. Finally, it could correspond to a thermal sensor. Various combinations of sensors such as smoke and thermal, gas and thermal, smoke, thermal and gas all could be used without departing from the spirit and scope of the present invention.

The sensors could incorporate local control circuitry such as local circuitry Proc 1, Proc 2 . . . Proc N which communicate with the control circuitry 18. Various types of processing can be carried out relative to the sensed information or indicia which indicate smoke concentration, gas concentration, thermal energy, rate of change of any or all of the above, all without limitation. Those of skill in the art will understand the various types of processing usable with the respective sensors. The control circuitry 18 can respond to processed outputs from the sensing units, such as the unit 26*n* all without limitation.

FIG. 3 is an exploded view of another embodiment 10' of a detector in accordance with the invention. The detector 10' includes a housing 12' which includes a proximal or interior section 12*a'*, a distal sensor carrying portion 12*b'*, and a central section 12*c'* which can exhibit a variable length.

Housing 12' can be slidably received in a flanged cylindrical mount indicated generally at 30. The mount 30 incorporates a planar flange 30*a* to which is attached an elongated tubular member 30*b*. Mounting structure 30 can be affixedly attached to the wall W by attaching the flange 30*a* to the interior surface W1.

Cylindrical mounting section 30*b* extends through the hole H in the wall W. The cylindrical mounting section 30*b* thus extends part way into the air gap between the adjacent surface C1 of the local chimney or flue and the interior surface W2 of the wall W. The housing 12' is slidably received within the mounting section of 30*b*. Once housing 12' has been inserted, the proximal housing portion 12*a'* abuts the flange 30*a*. The elongated variable length housing section 12*c'* extends through mounting member 30*b* to position the sensor section 12*b'* appropriately in the air gap between the surfaces C1 and W2.

As those of skill in the art will understand, the flange 30*a* can be attached with one or more fasteners 34*a,b* to the wall W. Neither the shape of flange 30*a* nor the shape and/or length of member 30*b* are limitations of the invention.

The housing 12' can be rotatably and releasably engaged with flange 30*a* via mounting posts 36*a,b* carried on flange 30*a*. The posts 36*a,b* slidably engage slots such as slots 38*a,b* (best seen in FIG. 5B) formed on surface 12*a'*-2 of proximal housing section 12*a'*. The surface 12*a'*-2 will be located adjacent to the flange 30*a* when the detector 10' is installed.

FIGS. 4A, 4B illustrate additional details of the construction of the detector 10'. The housing portion of 10*a'* can include a removable detector cover 12*a'*-1 which slidably engages an annular base having surfaces 12*a'*-2,-3. Control circuitry 18 as well as interface circuitry 20 and power source 22 can all be carried on the surface 12*a'*-2. The surface 12*a'*-2 can carry the control circuitry 18, interface circuitry 20, and power source circuitry 22, if any, on a printed circuit board as would be understood by those of skill in the art.

The sensor head 12*b'* can be provided with one or more depth stops such as stops 44*a,b*. The stops 44*a,b* displace the sensor head portion 12*b'* from the adjacent surface C1 of the chimney or flue a predetermined amount. They can be used in combination with variable length housing section 12*c'* to compensate for different wall thicknesses and depths as well as different air gaps depths depending on the nature and type of construction.

Those of skill will understand that the various features of the housing 12 can be modified without departing from the spirit and scope of the present invention. Different mechanisms can be provided for varying the length of the section 12*c'*. Similarly, the depth stops 44*a,b* can be adjusted by rotation or slidable engagement with the sensor head portion 12*b'* all without limitation. All such variations come within the spirit and scope of the present invention.

The housings 12, 12' can also carry a gasket, for example an O-ring (best seen in FIG. 3). The gasket provides a seal between the shaft 12, 12' of the detector and the mounting tube 30*b*. This reduces air infiltration from the monitored space and can promote energy savings.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A detector kit combining:

a mounting structure that has first and second ends, the mounting structure is adapted to be inserted through an opening in an adjacent two sided wall and located proximal to a chimney or flue, one end is located on a proximal side of the wall, with the other end located adjacent to the chimney or flue;

a combustion detecting unit releasably carried by the mounting structure adjacent to the other end;

an alarm transmitting control unit releasably carried by the mounting structure adjacent to the one end, the units are electrically coupled, the alarm transmitting unit is located adjacent to the proximal side of the wall and the detecting unit located adjacent to the chimney or flue when the mounting unit has been inserted into the opening in the wall.

2. A detector kit as in claim 1 where the combination detecting unit includes at least one of a heat sensor, a fire sensor, or a gas sensor.

3. A detector kit as in claim 2 where the control unit includes a processor and executable instructions responsive to the at least one sensor, for making an alarm determination.

4. A detector kit as in claim 3 where the control unit includes circuitry for communicating with another, displaced, device.

5. A detector kit as in claim 4 where the circuitry carries out at least one of wired or wireless communications with the another device.

6. A detector kit as in claim 3 where the processor and instructions carry out at least one of level processing, or, rate-of-change processing making the alarm determination.

7. A detector kit as in claim 1 where the combustion detecting unit and the alarm transmitting control unit are fixedly displaced relative to one another.

8. A detector kit as in claim 1 where the combustion detecting unit and the alarm transmitting control unit are fixedly carried relative to one another by a common housing.

* * * * *